US009474668B1

(12) United States Patent
Skursky

(10) Patent No.: US 9,474,668 B1
(45) Date of Patent: Oct. 25, 2016

(54) SPINE ASSISTING ROTATABLE TABLE

(71) Applicant: Elizabeth A. Skursky, Madeira Beach, FL (US)

(72) Inventor: Elizabeth A. Skursky, Madeira Beach, FL (US)

( * ) Notice: Subject to any disclaimer, the term of this patent is extended or adjusted under 35 U.S.C. 154(b) by 0 days.

(21) Appl. No.: 15/181,543

(22) Filed: Jun. 14, 2016

Related U.S. Application Data

(60) Provisional application No. 62/181,847, filed on Jun. 19, 2015.

(51) Int. Cl.
*A61G 7/005* (2006.01)
*A61G 7/05* (2006.01)

(52) U.S. Cl.
CPC ..... *A61G 7/005* (2013.01); *A61G 7/0506* (2013.01)

(58) Field of Classification Search
CPC ..... A63B 21/4029; A61H 37/00; A61G 13/009; A61G 2013/0054; A61G 13/121; A61G 13/125; A61G 13/128; A61G 7/005; A61G 7/0506
See application file for complete search history.

(56) References Cited

U.S. PATENT DOCUMENTS 3,897,102 A 7/1975 Lemaire
4,650,249 A 3/1987 Serber
4,653,751 A * 3/1987 Green ..... A63B 21/4029 482/104
4,943,117 A 7/1990 Brown
5,882,283 A * 3/1999 Stevens ..... A63B 21/078 482/104
5,971,485 A 10/1999 Clark
6,287,243 B1 * 9/2001 Isom ..... A63B 21/078 482/104
6,605,023 B1 * 8/2003 Mobley ..... A63B 21/078 482/142
6,698,831 B2 3/2004 Lloyd
6,966,872 B2 * 11/2005 Eschenbach ..... A63B 21/068 482/142
7,144,080 B2 12/2006 Lloyd
7,674,215 B1 * 3/2010 Swanson ..... A63B 21/078 482/142
RE43,193 E * 2/2012 Osborne ..... A47C 19/045 5/600
2003/0211920 A1 * 11/2003 Mandel ..... A63B 21/015 482/116
2013/0150219 A1 * 6/2013 Chang ..... A61H 1/0229 482/144
2013/0203569 A1 * 8/2013 Athis ..... A63B 21/0552 482/142
2015/0038304 A1 * 2/2015 Davenport ..... A63B 21/4035 482/123

* cited by examiner

*Primary Examiner* — Philip Gabler
(74) *Attorney, Agent, or Firm* — Thomas Frost

(57) ABSTRACT

The invention relates to an adjustable table for use while laying in a prone position. A bench frame is pivotally attached to a support frame. A post is pivotally connected to the bench frame provides means to adjust the angle between the bench frame and the support frame. A headrest is provided for securing the head while laying face down. A detachable foot platform is also provided.

8 Claims, 7 Drawing Sheets

SPINE ASSISTING ROTATABLE TABLE

FIELD OF THE INVENTION

The present invention relates to an adjustable table for relieving back stress (including lower and upper spine, and extremities) while in a prone position.

BACKGROUND OF THE INVENTION

The general purpose of the present invention, which will be described subsequently in greater detail, is to provide a new and improved table device.

An individual having an injured cervical and/or lumbar back regions needs to minimize the stress and strain on the lower back. Lying in a prone position on ones stomach minimizes stress and strain on the lower back, and also reduces strain on the neck. Such an individual cannot work at a desk without a great deal of discomfort.

The current invention provides a way for an individual to work at a desk while in a prone position.

SUMMARY OF THE INVENTION

The general purpose of the present invention, which will be described subsequently in greater detail, is to provide a new and improved table for lying in a prone position.

The device comprises a bench frame which is pivotally attached to a support frame at a first end. A post is connected to the bench frame, and provides means to adjust the angle between the bench frame and the support frame. A headrest is provided. A detachable foot platform is also provided.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
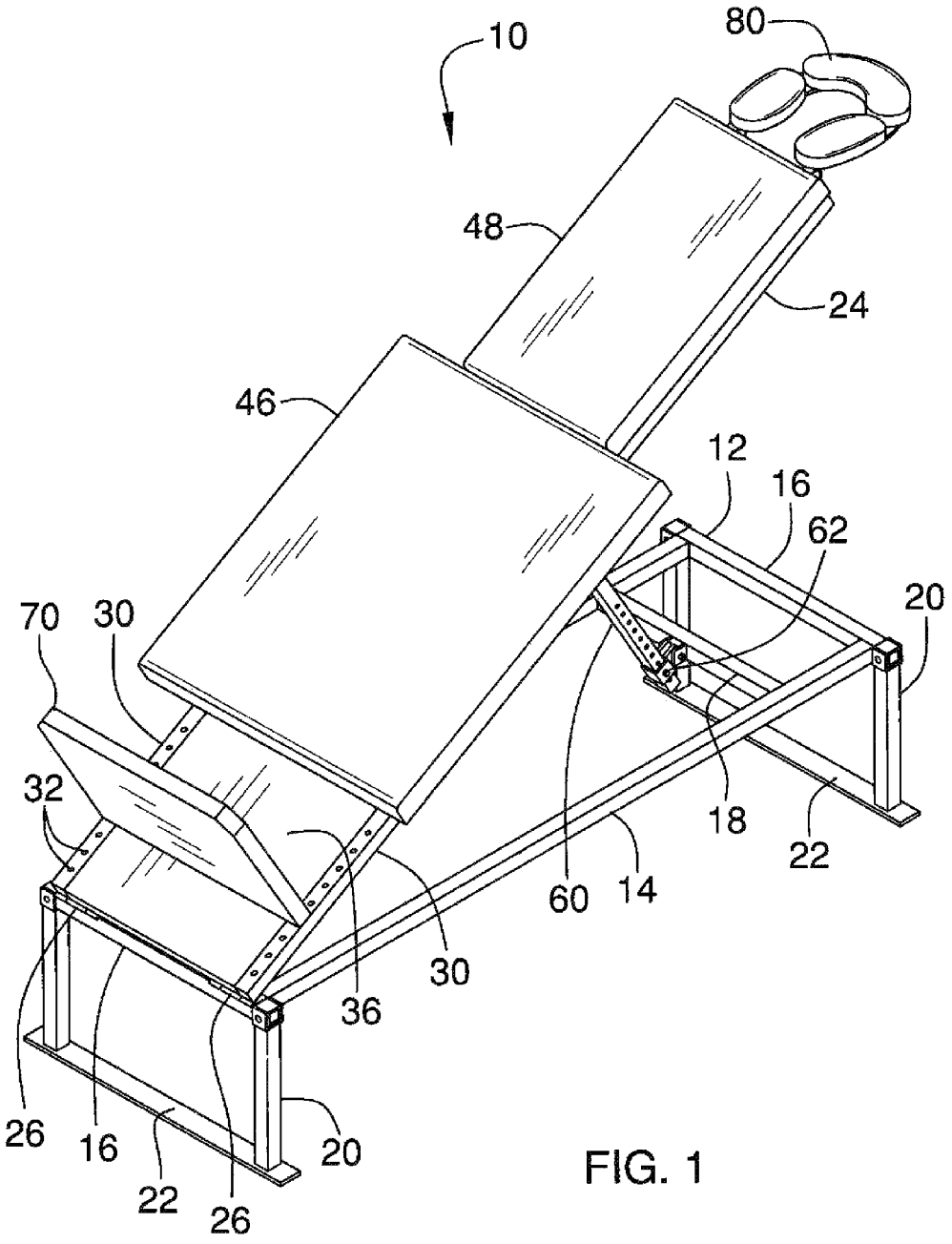
FIG. 1 is a perspective view of the present invention with a bench frame in a raised position.
Figure 2:
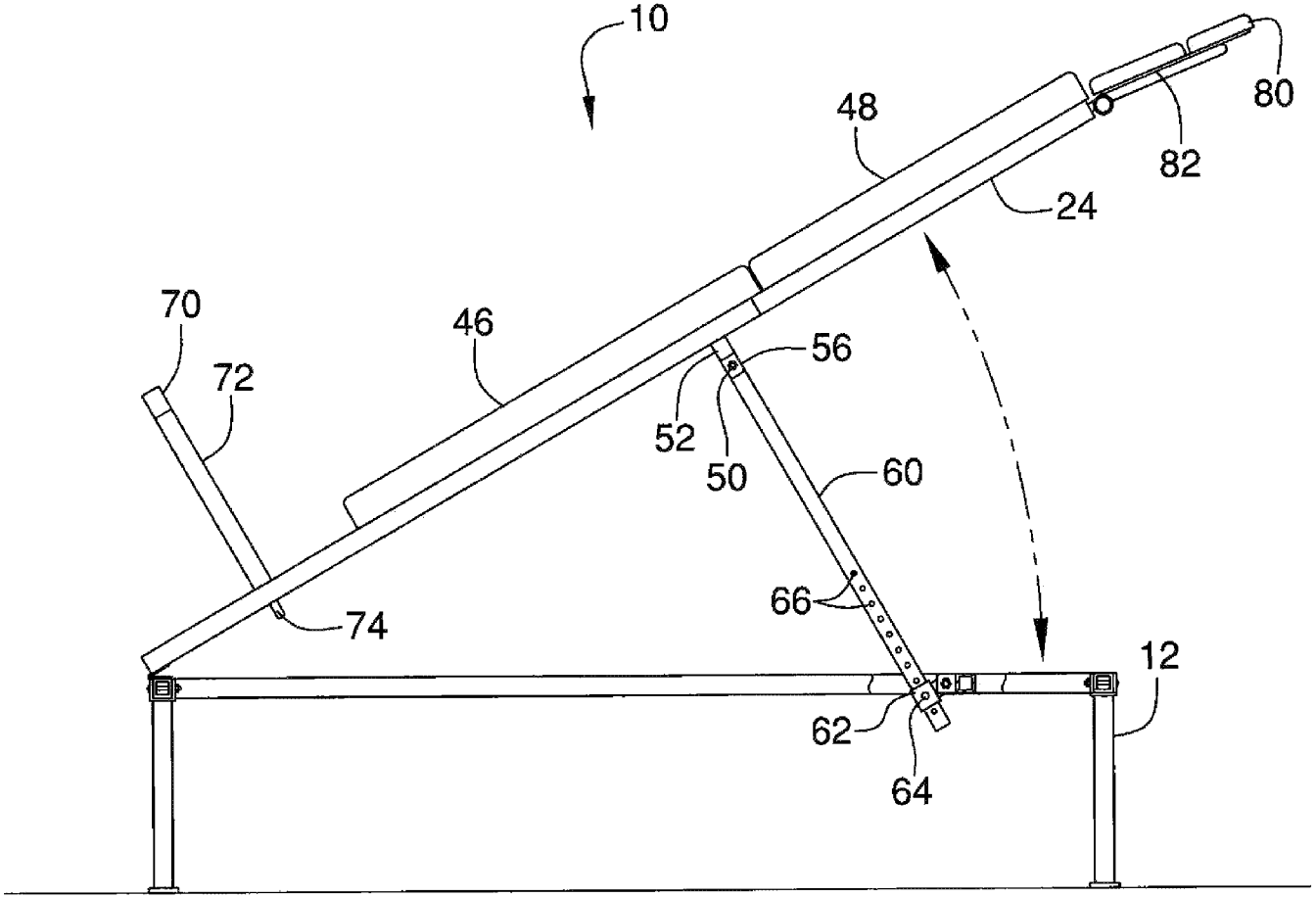
FIG. 2 is a side elevational view with the bench frame in raised position.
Figure 3:
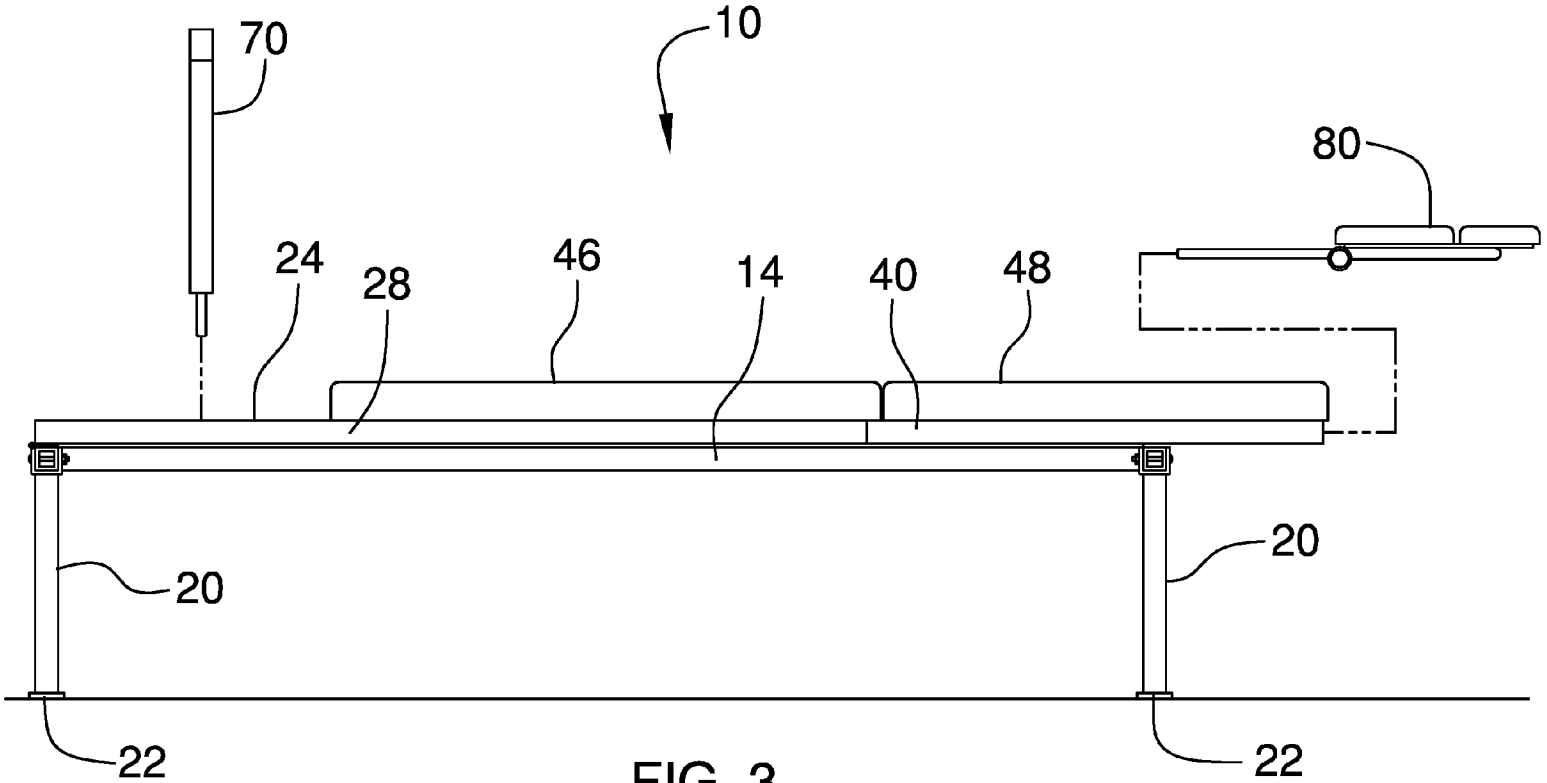
FIG. 3 is a side elevational view with the bench frame in lowered position.
Figure 4:
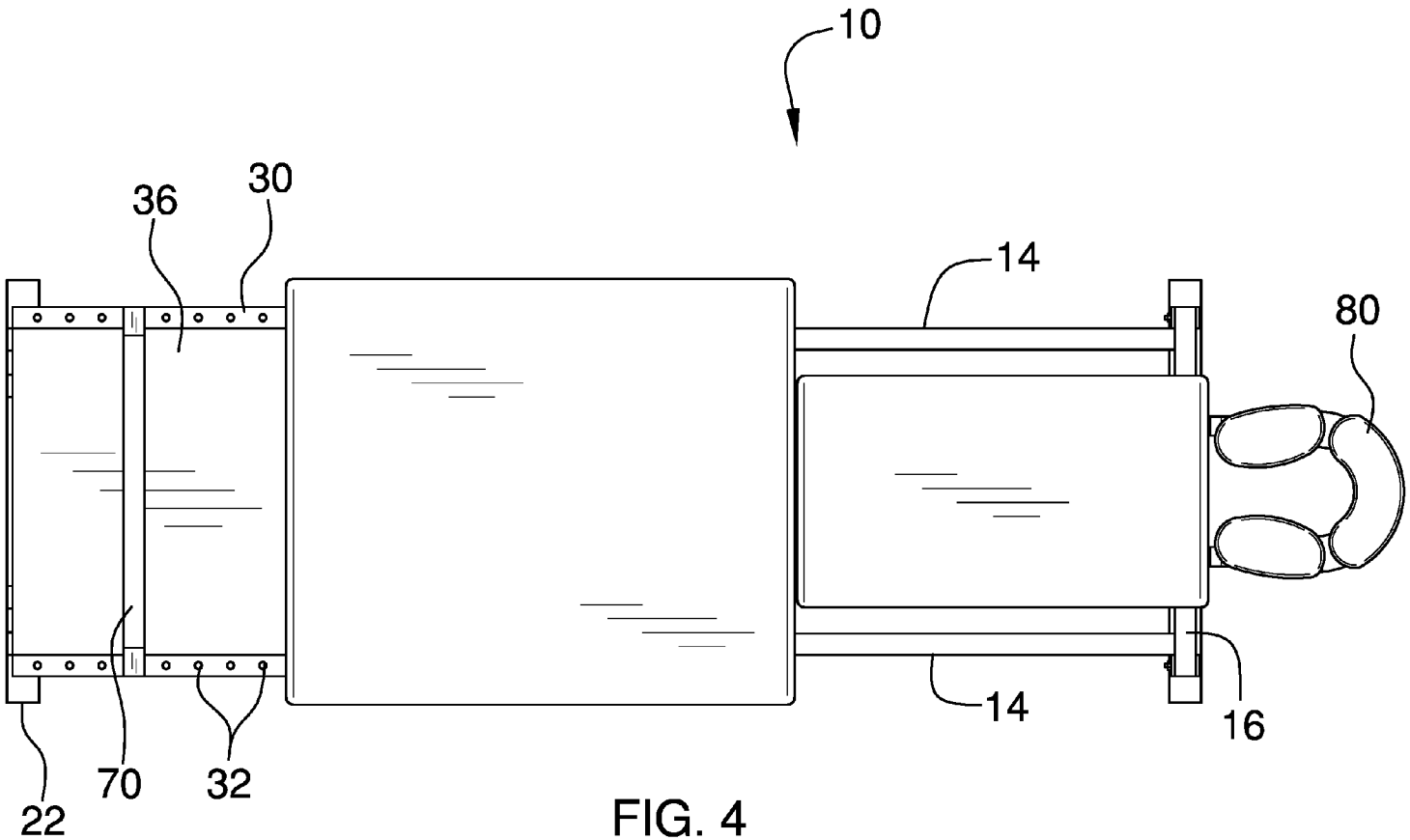
FIG. 4 is a top plan view of the invention.

Referring generally to the FIGS. 1-7, the present invention 10 is illustrated. A generally rectangular base support frame 12 has a pair of longitudinally placed side rails 14 and a pair of opposed lateral end rails 16 aligned perpendicular to the side rails 14, and affixed to the side rails 14 at opposed ends. A cross brace 18 is affixed to inner surfaces of the side rails 14. Legs 20 are fixedly joined at one end to the end rails 16 and at the other end to base support members 22. The support members 22 contact a supporting surface, such as a floor. The support frame 12 is preferably composed of rectangular tubing.

Figure 5:
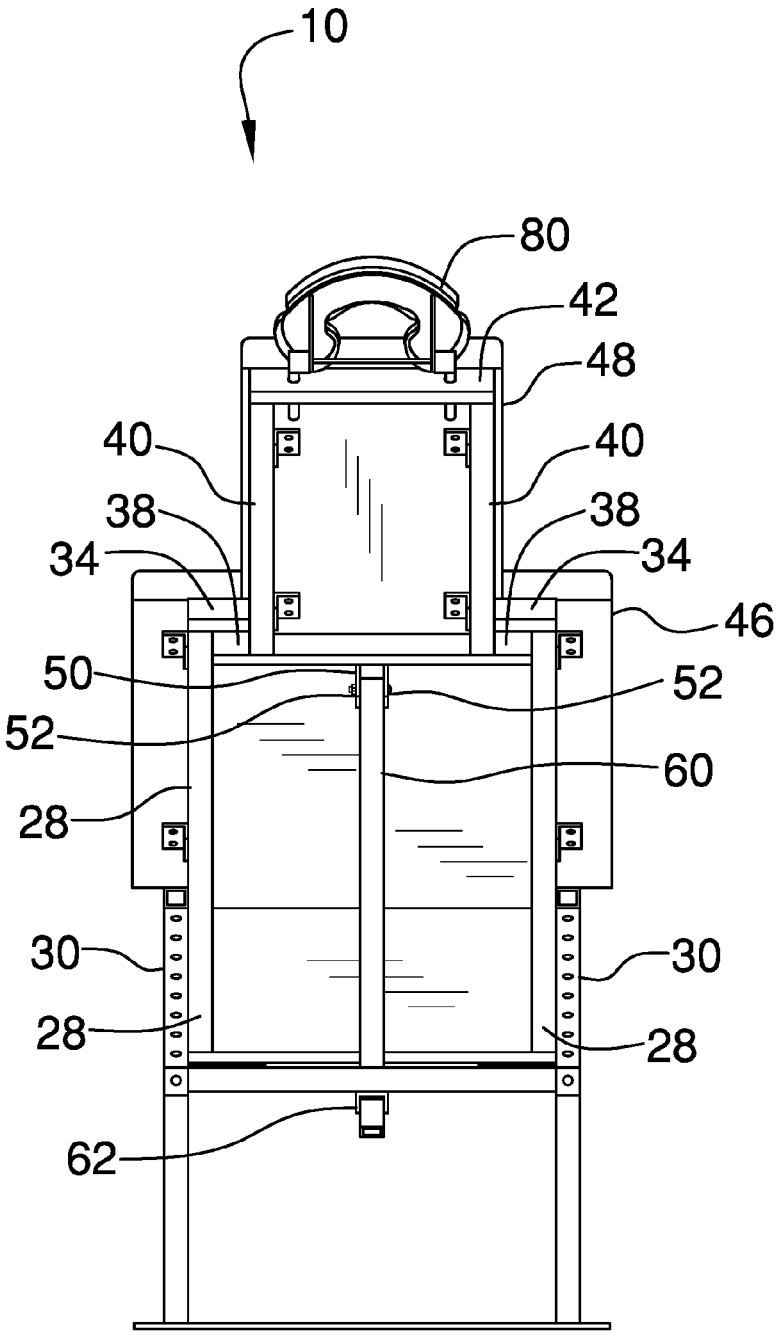
FIG. 5 is a front elevational view of the bench frame in raised position.
Figure 7:
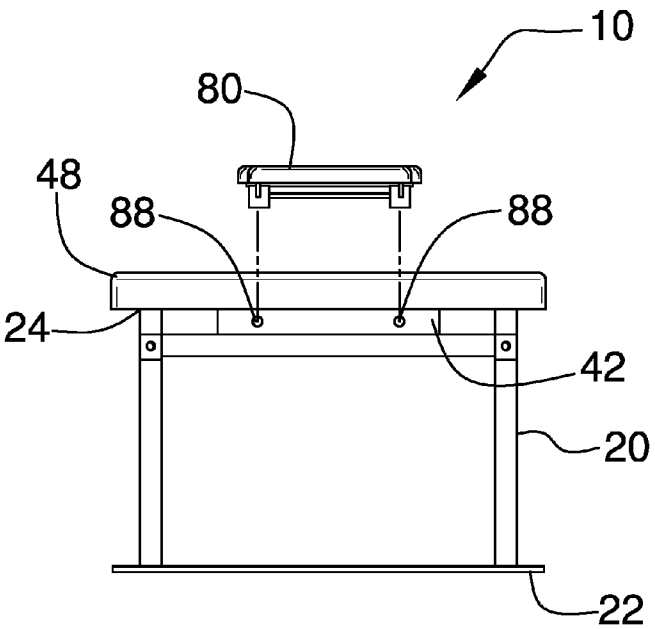
FIG. 7 is a front elevational view illustrating positioning of a headrest.
Figure 6:
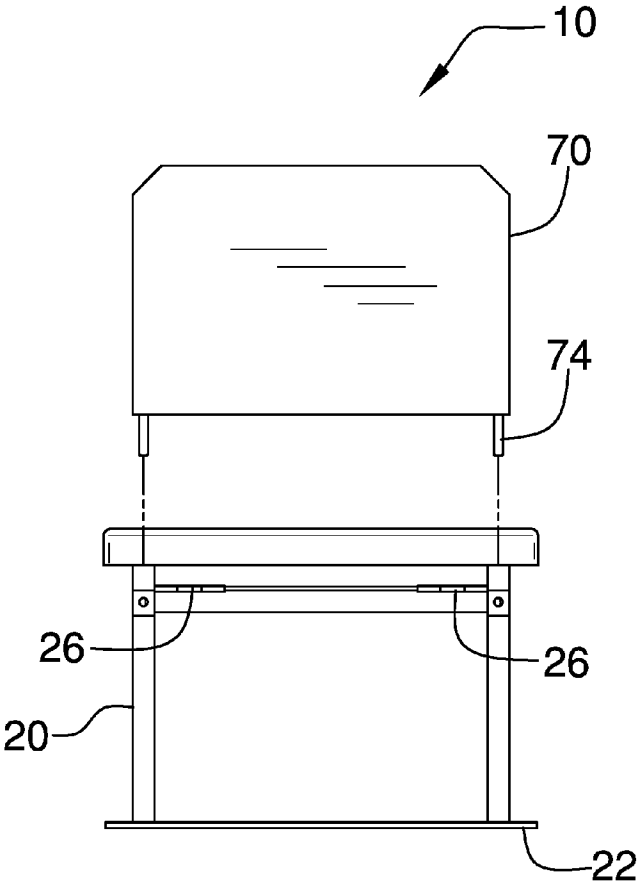
FIG. 6 is a rear elevational view of the invention illustrating positioning of a foot platform.
Figure 8:
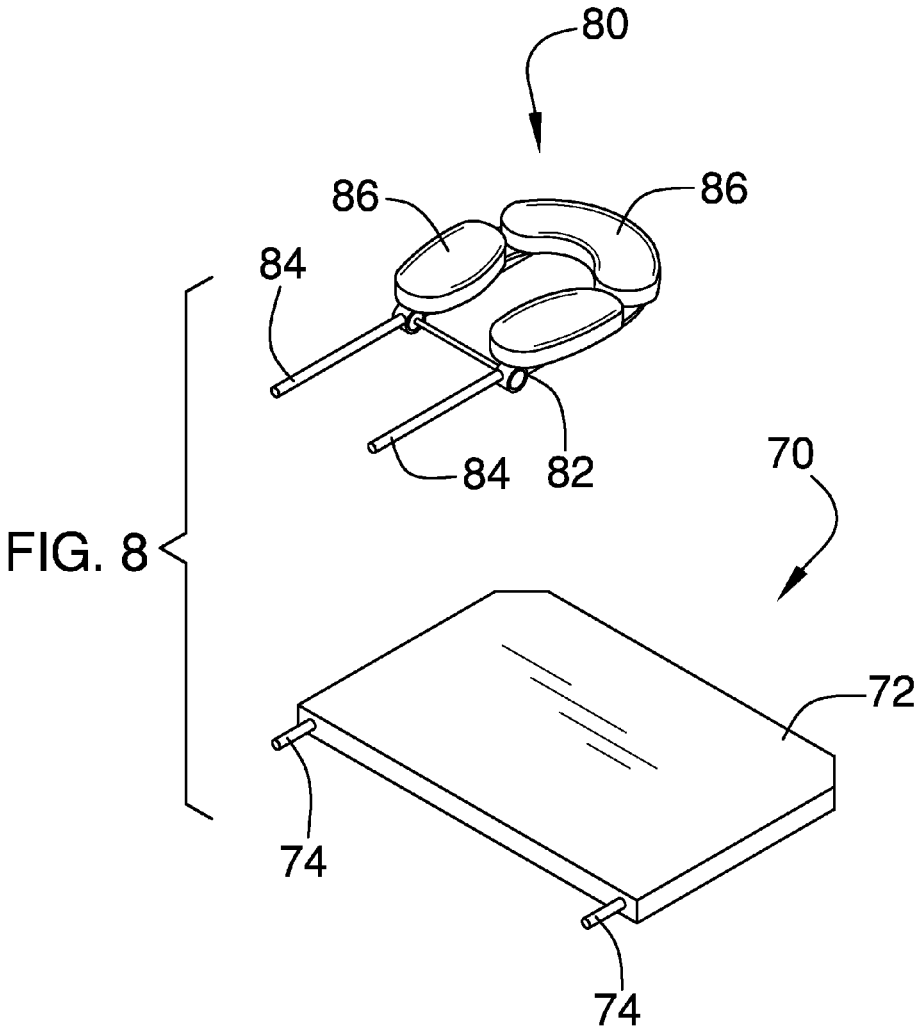
FIG. 8 illustrates perspective views of the headrest and the foot platform.

As more particularly shown in FIG. 5, a bench frame 24 having a first end (foot end) and a second end (head end) is pivotally connected at the first end to the support frame 12, preferably by hinges 26. The bench frame 24 has a first pair of inner longitudinally placed rails 28 and a pair of outer longitudinally placed rails 30. The inner rails 28 are relatively greater in length than the outer rails 30. The outer rails 30 have apertures 32 formed therethrough. A lateral rail 34 is aligned perpendicular to, and mounted to first ends of the rails 28,30. A panel 36 having an upper planer surface and a lower planer surface is mounted between the inner rails 28 and the lateral rail 34. A cross brace 38 having an upper surface and a lower surface is affixed to inner surfaces of the inner rails 28. A second pair of outer longitudinally placed rails 40 extend from the cross brace 38, and a lateral end rail 42 is affixed to a second end of the outer rails 40. The bench frame 24 is preferably composed of rectangular tubing.

A first body section pad 46, which may include multiple sections, and a second body section pad 48 are mounted on an upper surface of the bench frame 24. The first pad 46 is positioned principally for the lower body torso and the second pad 48 is positioned principally for the upper body. As illustrated the first pad 46 is relatively wider than the second pad 48, allowing a user to hang their arms off of the second pad 48.

Referring to the FIG. 5, pivot means 50, preferably comprised of a pair of opposed downwardly depending plates 52 having apertures formed therethrough and a bolt and nut 56, is affixed to the cross brace 38 of the bench frame 24. A tubular post 60 having a top wall, bottom wall and side walls has an aperture formed though the side walls formed juxtaposed a first end of the post 60. The post 60 is demountably secured to the pivot means 50, and is pivotally attached to the bench frame 24. A generally U-shaped bracket 62 is pivotally affixed to the cross brace 18 of the support frame 12. The bracket 62 has apertures formed therethrough to accept a locking mechanism 64, such as a nut and bolt, or a spring-loaded pin. The post 60 has a series of adjustment apertures 66 formed through the side walls relative a second end. The apertures 66 are dimensioned to be operatively engaged with the locking means 64. Thus, the post 60 is vertically adjustable to selectively adjust the angle of the support frame 12 relative to the bench frame 24 by aligning the post 60 though the bracket 62 at different levels. The locking mechanism 64 is disengaged and then selectively engage at a different adjustment aperture. The U-shaped bracket 62 pivots to accommodate the post 60 movement in securely engaging with the locking mechanism 64.

The post 60 when disengaged from the locking means 64 pivots horizontally relative to the supporting surface, such as the floor, and the bench frame 24 is positioned parallel to the support frame 12.

A foot platform 70 comprised of a panel 72 and a pair of rods 74 is detachably connected by engaging the rods 74 though the apertures 32 of the outer rails 30. It can be readily seen that the positioning of the platform 70 can be adjusted according to the height of a user.

A headrest 80 comprised of a headrest frame support 82 with a pair of dowels 84 and a plurality of headrest cushion sections 86 is slidably connected to channels 88 integrally formed at the second end of the bench frame 24. An individual may lay face down on the headrest cushion sections 86 and not have to turn their neck or head to breathe.

The table 10 allows the user to lay face down which may relieve or reduce lower back pain, which is lumbar spine stress from sitting or standing. The headrest 80 supports the head, which may reduce or remove neck pain caused by cervical spine stress. The detachable and adjustable foot platform 70 allows the user to effectively position the body and head for work at a desk. It can be readily seen that the second pad 48 is narrowed to maximize the ability of the arms and hands to move and manipulate under the bench frame 24 and perform work on the surface of a standard desk.

In use, the table 10 is positioned perpendicular to a desk. The angle of incline for the bench frame 24 is adjusted to the desired height relative to a desk. The foot platform 70 is adjusted to position the body, hands and feet. The user then mounts the table 10 and lays in a prone position.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

I claim:

1. A spine assisting table, comprising in combination:

a base support frame having a first foot end and a second head end, comprising a pair of longitudinally placed side rails, a pair of opposed lateral end rails having first ends and second ends, aligned perpendicular to the side rails and affixed to the side rails at the opposed ends, a cross brace affixed to inner surfaces of the side rails, and a set of pairs of legs each fixedly joined at first ends to the lateral end rails and at second ends of the legs to base support members;

a bench frame having a first foot end and a second head end, and comprising a first section having a first pair of outer longitudinally placed rails having apertures formed therethrough positioned near the first end of the bench frame, a first pair of inner longitudinally placed rails aligned parallel to the outer longitudinally placed rails, a lateral rail aligned and mounted perpendicular to first ends of the outer rails and the inner rails, and a cross brace affixed to inner surfaces of the inner place rails; and further having a second section having a second pair of outer longitudinally placed rails extending from the cross brace and a lateral end rail affixed to second ends of the second pair of outer longitudinally placed rails; and whereby the bench frame is pivotally affixed at the first end to the base support frame by hinges at the first end of the base support frame;

a first body section pad mounted on the first section of the bench frame;

a second body section pad mounted on the second section of the bench frame;

pivot means affixed to a bottom surface of the bench frame;

a tubular post secured to the pivot means;

a U-shaped bracket having apertures therethrough to accept a locking mechanism, and being pivotally affixed to the cross brace of the support frame; and whereby the post is vertically adjustable to selectively adjust the angle of the support frame relative to the bench frame by aligning the post through the bracket at different levels.

2. The table as set forth in claim 1, further comprising a foot platform having a panel and a pair of rods, and whereby the platform is detachably connected in perpendicular alignment to the bench frame by engaging the rods through the apertures of the first pair of outer longitudinally placed rails.

3. The table as set forth in claim 2, wherein the lateral end rail of the bench frame has a pair of channels formed therein, and further comprising a headrest having a headrest support with a pair of dowels and a plurality of cushion sections slidably mounted to the lateral end rail of the bench frame.

4. The table as set forth in claim 1, whereby the locking mechanism attached to the bracket is a nut and a bolt.

5. The table as set forth in claim 1, whereby the locking mechanism attached to the bracket is a spring-loaded pin.

6. A spine assisting table, comprising in combination:

a base support frame;

a bench frame having a first foot end and a second head end, and comprising a first section having a first pair of outer longitudinally placed rails having apertures formed therethrough positioned near the first end of the bench frame, a first pair of inner longitudinally placed rails aligned parallel to the outer longitudinally placed rails, a lateral rail aligned and mounted perpendicular to first ends of the outer rails and the inner rails, and a cross brace affixed to inner surfaces of the inner place rails; and further having a second section having a second pair of outer longitudinally placed rails extending from the cross brace and a lateral end rail affixed to second ends of the second pair of outer longitudinally placed rails; and whereby the bench frame is pivotally affixed at the first end to the base support frame by hinges at the first end of the base support frame;

a first body section pad mounted on the first section of the bench frame;

a second body section pad mounted on the second section of the bench frame;

pivot means affixed to a bottom surface of the bench frame;

a tubular post secured to the pivot means;

a U-shaped bracket having apertures therethrough to accept a locking mechanism, and being pivotally affixed to the base support frame;

a foot platform having a panel and a pair of rods, and whereby the platform is detachably connected in perpendicular alignment to the bench frame by engaging the rods through the apertures of the first pair of outer longitudinally placed rails; and whereby the post is vertically adjustable to selectively adjust the angle of the support frame relative to the bench frame by aligning the post through the bracket at different levels.

7. The table as set forth in claim 6, whereby the pivot means comprises a pair of opposed downwardly depending plates having apertures formed therethrough, and having a nut and a bolt extended through the apertures, and whereby the pivot means is affixed to the cross brace of the bench frame.

8. A spine assisting table, comprising in combination:

a base support frame;

a bench frame having a first foot end and a second head end, and comprising a first section having a first pair of outer longitudinally placed rails, a first pair of inner longitudinally placed rails aligned parallel to the outer longitudinally placed rails, a lateral rail aligned and mounted perpendicular to first ends of the outer rails and the inner rails, and a cross brace affixed to inner surfaces of the inner place rails; and further having a second section having a second pair of outer longitudinally placed rails extending from the cross brace and a lateral end rail having a pair of channels formed therein affixed to second ends of the second pair of outer longitudinally placed rails; and whereby the bench frame is pivotally affixed at the first end to the base support frame by hinges at the first end of the base support frame;

a first body section pad mounted on the first section of the bench frame;

a second body section pad mounted on the second section of the bench frame;

pivot means affixed to a bottom surface of the bench frame;

a tubular post secured to the pivot means;

a U-shaped bracket having apertures therethrough to accept a locking mechanism, and being pivotally affixed to the base support frame;

a headrest having a headrest support with a pair of dowels and a plurality of cushion sections slidably mounted to the lateral end rail of the bench frame, whereby the post is vertically adjustable to selectively adjust the angle of the support frame relative to the bench frame by aligning the post through the bracket at different levels.

* * * * *